US011244616B2

(12) United States Patent
Guo et al.

(10) Patent No.: US 11,244,616 B2
(45) Date of Patent: Feb. 8, 2022

(54) DISPLAY PANEL AND IMAGE DATA COMPENSATION METHOD THEREOF

(71) Applicant: SHENZHEN ROYOLE TECHNOLOGIES CO., LTD., Guangdong (CN)

(72) Inventors: Xingling Guo, Guangdong (CN); Xiaoping Tan, Guangdong (CN)

(73) Assignee: SHENZHEN ROYOLE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/159,630

(22) Filed: Jan. 27, 2021

(65) Prior Publication Data

US 2021/0150983 A1 May 20, 2021

Related U.S. Application Data

(63) Continuation of application No. PCT/CN2018/097639, filed on Jul. 27, 2018.

(51) Int. Cl.
*G09G 3/3233* (2016.01)
*G09G 5/12* (2006.01)

(52) U.S. Cl.
CPC ..... *G09G 3/3233* (2013.01); *G09G 5/12* (2013.01); *G09G 2320/0295* (2013.01); *G09G 2320/045* (2013.01)

(58) Field of Classification Search
None
See application file for complete search history.

(56) References Cited

U.S. PATENT DOCUMENTS

2011/0050674 A1* 3/2011 Kim ..... G09G 3/3233 345/211
2018/0039107 A1* 2/2018 Sasaki ..... G09G 3/2096

FOREIGN PATENT DOCUMENTS

CN 105632443 A 6/2016
CN 107180616 A 9/2017
CN 108053793 A 5/2018

OTHER PUBLICATIONS

International Search Report issued in corresponding International Application No. PCT/CN2018/097639, dated May 6, 2019.

* cited by examiner

*Primary Examiner* — Ifedayo B Iluyomade
(74) *Attorney, Agent, or Firm* — Hauptman Ham, LLP

(57) ABSTRACT

A display panel and an image data compensation method thereof are provided. The display panel includes a first data driving module and a second data driving module. The first data driving module is configured to provide image data signals for a first display area and perform De-Mura compensation. The second data driving module is configured to provide image data signals for a second display area and perform De-Mura compensation. The first data driving module is configured to obtain image data of the second display area after De-Mura compensation, and adjust image data of a first compensation area adjacent to the second display area in the first display area. The second data driving module is configured to obtain image data of the first display area after De-Mura compensation, and adjust image data of a second compensation area adjacent to the first display area in the second display area.

15 Claims, 5 Drawing Sheets

DISPLAY PANEL AND IMAGE DATA COMPENSATION METHOD THEREOF

CROSS-REFERENCE TO RELATED APPLICATION(S)

This application is a continuation of International Application No. PCT/CN2018/097639, filed on Jul. 27, 2018, the disclosure of which is hereby incorporated by reference in its entirety.

TECHNICAL FIELD

This disclosure relates to the field of display technologies, and particularly to a display panel and an image data compensation method thereof.

BACKGROUND

Display panel is more and more widely used in various electronic products. With the growing user demands for characteristics of the electronic product such as light, thin, high screen-to-body ratio, low power consumption, and high contrast, the display panel has evolved from the liquid crystal display (LCD) panel to the organic light-emitting diode (OLED) panel. OLED is a current-type light-emitting device, however, for the OLED panel, OLED display may experience uneven brightness and image retention which are main problems to be solved. Generally, De-Mura compensation is adopted to compensate a current frame of image data (i.e., a current picture) to be displayed on the OLED panel. The De-Mura compensation includes the following. According to overall brightness information of the display panel obtained by shooting with an optical element, brightness information of each pixel unit or each pixel block of the display panel is obtained. A compensation coefficient of each gray level for each pixel unit is calculated according to the obtained brightness information. Image data to-be-displayed is compensated with the compensation coefficient.

Since a large-size display panel is equipped with multiple data integrated circuits (data IC) for De-Mura compensation, black lines may appear in images displayed by the display panel after De-Mura compensation, which seriously affects quality of image display.

SUMMARY

In view of the above deficiencies, implementations of the disclosure provide a display panel, which can improve display quality of the display panel by compensating image data of the display panel.

Implementations of the disclosure further provide an image data compensation method of the display panel.

According to implementations of the disclosure, a display panel is provided. The display panel has a first display area and a second display area adjacent to each other along a first direction. The first display area includes a plurality of pixel columns $P_1$-$P_n$ sequentially arranged along the first direction. The second display area includes a plurality of pixel columns $P_{n+1}$-$P_m$ sequentially arranged along the first direction. The first display area includes a first compensation area. The first compensation area at least includes the pixel column $P_n$. The second display area includes a second compensation area. The second compensation area is adjacent to the first display area and at least includes the pixel column $P_{n+1}$, where m is a positive integer greater than n. The display panel includes a first data driving module and a second data driving module, where the first data driving module is configured to provide an image data signal for the pixel columns $P_1$-$P_n$, and the second data driving module is configured to provide an image data signal for the pixel columns $P_{n+1}$-$P_m$. The first data driving module is configured to perform De-Mura compensation on the first display area, obtain image data of the second display area after De-Mura compensation, and adjust image data of the first compensation area according to the obtained image data of the second display area. The second data driving module is configured to perform De-Mura compensation on the second display area, obtain image data of the first display area after De-Mura compensation, and adjust image data of the second compensation area according to the obtained image data of the first display area, where the adjusted image data of the first compensation area and the adjusted image data of the second compensation area are in a continuous distribution.

According to implementations of the disclosure, an image data compensation method of a display panel is provided. The display panel has a first display area and a second display area adjacent to each other along a first direction. The first display area includes a plurality of pixel columns $P_1$-$P_n$ sequentially arranged along the first direction. The second display area includes a plurality of pixel columns $P_{n+1}$-$P_m$ sequentially arranged along the first direction. The first display area includes a first compensation area which at least includes the pixel column $P_n$. The second display area includes a second compensation area which is adjacent to the first display area and at least includes the pixel column $P_{n+1}$. The image data compensation method includes the following. Image data to-be-displayed is obtained. De-Mura compensation is performed on image data of the first display area and image data of the second display area. Image data of the second display area after De-Mura compensation is obtained, and image data of the first compensation area is compensated according to the obtained image data of the second display area. Image data of the first display area after De-Mura compensation is obtained, and image data of the second compensation area is compensated according to the obtained image data of the first display area, where the compensated image data of the first compensation area and the compensated image data of the second compensation area are in a continuous distribution.

Compared with the related art, in the disclosure, the compensation for the first compensation area and the second compensation area is performed, so that image data of pixel columns at positions adjacent to the first display area and the second display area (hereinafter, a boundary area for short) has same change trend and is in a continuous distribution. As such, the image data of the pixel columns in the boundary area can be in a continuous distribution visually without perceiving a black line.

BRIEF DESCRIPTION OF THE DRAWINGS

In order to describe technical solutions of implementations of the disclosure more clearly, the following will give a brief description of accompanying drawings used for describing the implementations. Apparently, accompanying drawings described below are merely some implementations. Those of ordinary skill in the art can also obtain other accompanying drawings based on the accompanying drawings described below without creative efforts.

DETAILED DESCRIPTION

Technical solutions of implementations of the disclosure will be described clearly and completely with reference to accompanying drawings in the implementations. Apparently, implementations described hereinafter are merely some implementations, rather than all implementations of the disclosure. All other implementations obtained by those of ordinary skill in the art based on the implementations without creative efforts shall fall within the protection scope of the disclosure.

Hereinafter, function modules of a display panel and a compensation method of the display panel will be described in detail with reference to the accompanying drawings.

Figure 1:
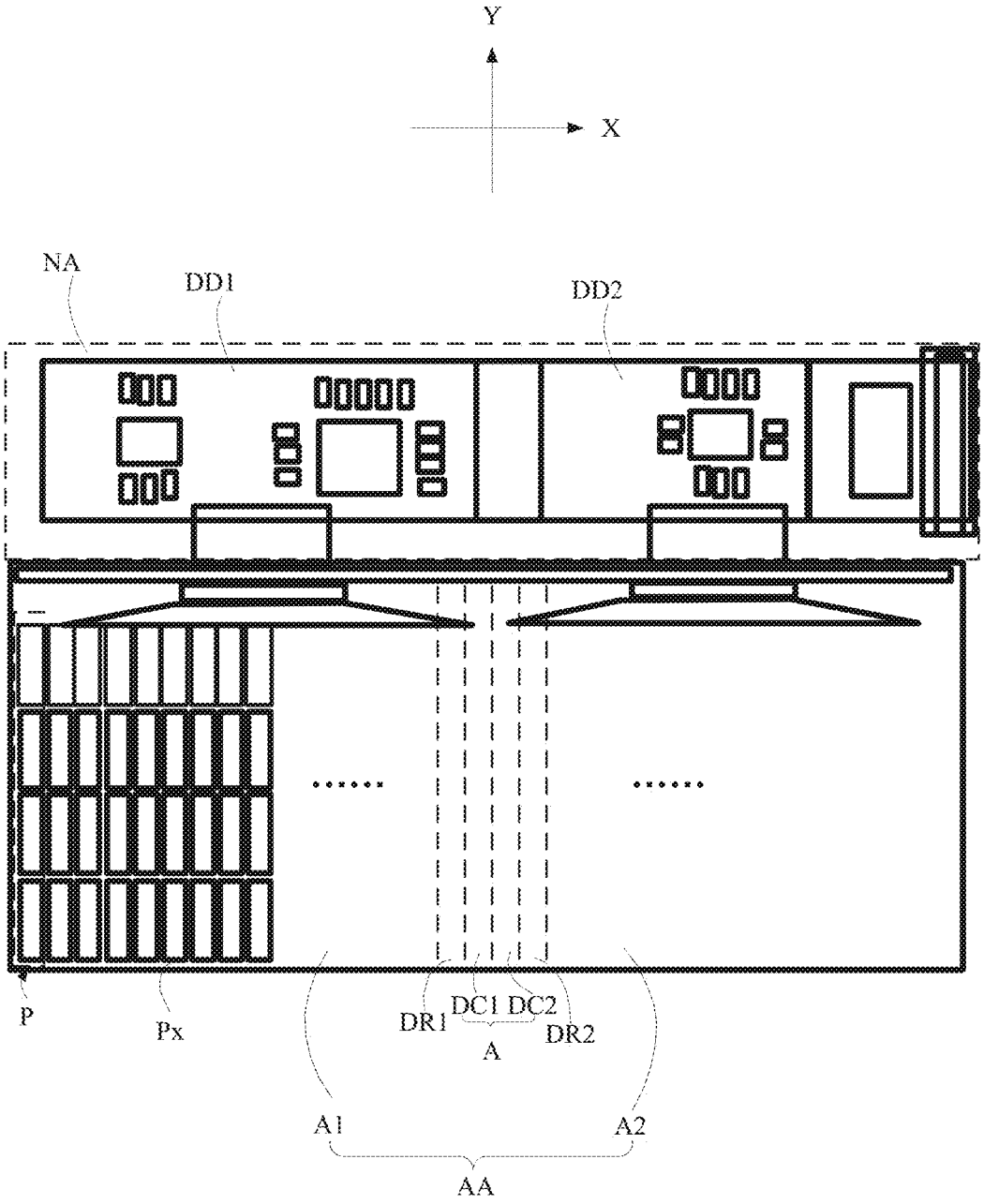
FIG. 1 is a schematic structural diagram illustrating a plane structure of a display panel according to implementations.

FIG. 1 is a schematic structural diagram illustrating a plane structure of a display panel according to implementations. As illustrated in FIG. 1, a display panel 10 has a display area AA and a non-display area NA. The display area AA includes a first display area A1 and a second display area A2 adjacent to the first display area A1 along a first direction X. The first display area A1 includes multiple pixel columns P sequentially arranged along the first direction X, and the pixel columns P are expressed as $P_1$-$P_n$. The second display area A2 includes multiple pixel columns P sequentially arranged along the first direction X, and the pixel columns P are expressed as $P_{n+1}$-$P_m$, where m and n are positive integers greater than 1, and m is greater than n.

Each of the pixel columns $P_1$-$P_m$ includes pixel units $P_x$ sequentially arranged along a second direction Y. The second direction Y is perpendicular to the first direction X. Pixel units $P_x$ are configured for image display. In the implementation, the first direction X is the horizontal direction, and the second direction Y is the vertical direction.

A first data driving module DD1 and a second data driving module DD2 are disposed in the non-display area NA of the display panel 10. The first data driving module DD1 and the second data driving module DD2 are configured to provide the pixel units $P_x$ of the pixel columns $P_1$-$P_m$ with image data for image display.

Figure 2:
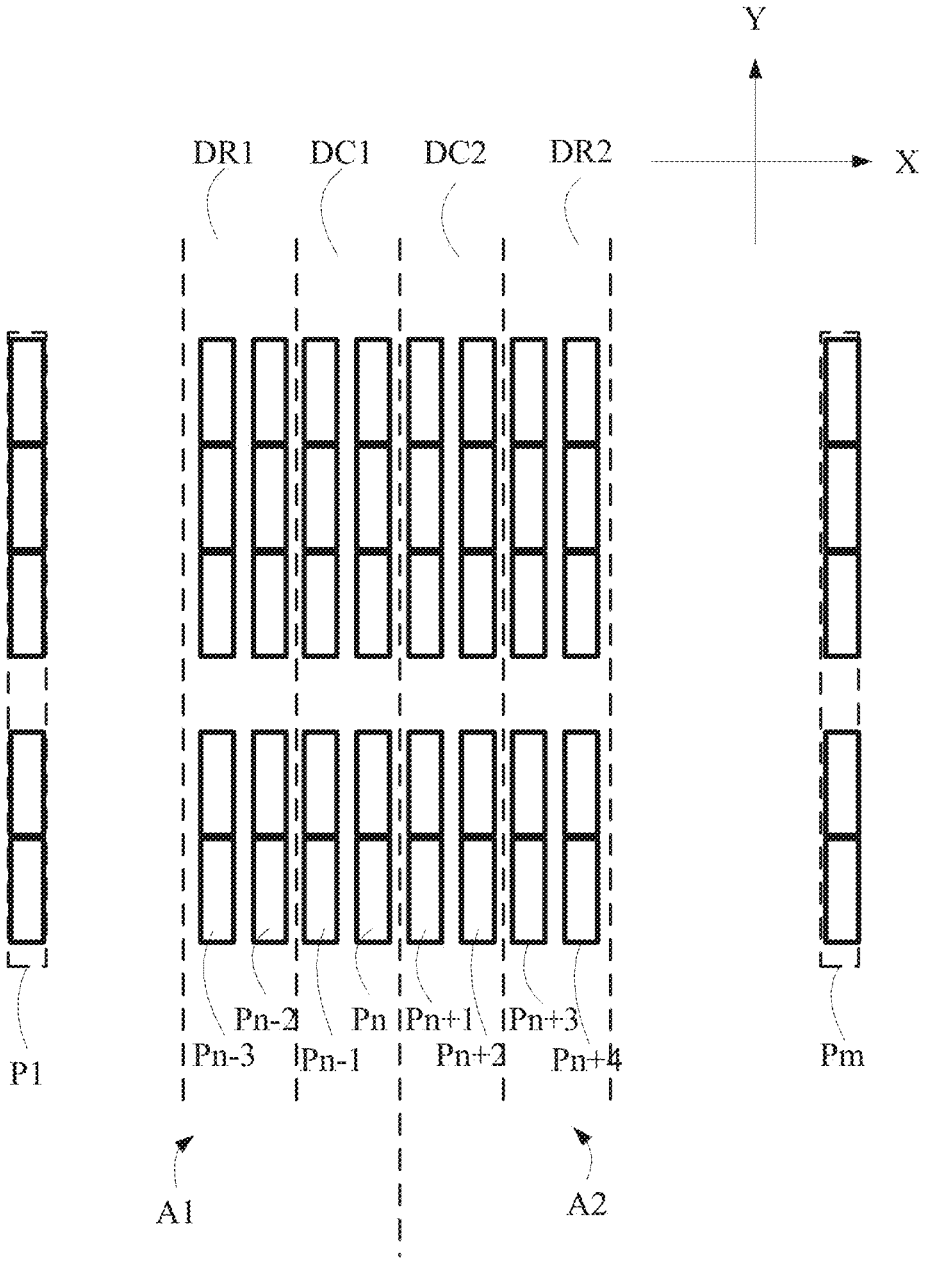
FIG. 2 is a schematic structural diagram illustrating part of pixel columns in a display area illustrated in FIG. 1 according to implementations.

FIG. 2 is a schematic structural diagram illustrating part of pixel columns in the display area AA illustrated in FIG. 1 according to implementations. As illustrated in FIG. 1 and FIG. 2, the first display area A1 includes a first compensation reference area DR1 and a first compensation area DC1 which are arranged in parallel with each other and adjacent to the second display area A2. The first compensation area DC1 is closer to the second display area A2 than the first compensation reference area DR1. The first compensation reference area DR1 is a display area which at least includes two pixel columns, that is, a display area which is adjacent to the pixel column $P_n$ and at least includes two pixel columns. The first compensation reference area DR1 may include the pixel column $P_n$. Pixel columns in the first compensation reference area DR1 can include: pixel column $P_{n-i}$ to pixel column $P_{n-i+j}$, where i is a positive integer greater than 0, j is a positive integer greater than or equal to 1, and $j \leq 1$.

The first compensation area DC1 is a display area at least including the pixel column $P_n$, which is nearest to the second display area A2. Pixel columns in the first compensation area DC1 can include: pixel column $P_{n-k}$ to pixel column $P_n$, where k is a positive integer greater than or equal to 0.

In some implementations, the first compensation reference area DR1 overlaps with the first compensation area DC1. In some implementations, the first compensation reference area DR1 is adjacent to but does not overlap with the first compensation area DC1.

The second display area A2 includes a second compensation reference area DR2 and a second compensation area DC2 which are arranged in parallel with each other and adjacent to the first display area A1. The second compensation area DC2 is closer to the first display area A1 than the second compensation reference area DR2. The second compensation reference area DR2 is a display area which is adjacent to the first display area A1 and at least includes two pixel columns, that is, a display area which is adjacent to pixel column $P_{n+1}$ and at least includes two pixel columns. The second compensation reference area DR2 may include the pixel column $P_{n+1}$. Pixel columns in the second compensation reference area DR2 can include: pixel column $P_{n+1+i}$ to pixel column $P_{n+1+i+j}$.

The second compensation area DC2 is a display area adjacent to the first display area A1 and at least including the pixel column $P_{n+1}$, which is nearest to the first display area A1. Pixel columns in the second compensation area DC2 can include: pixel column $P_{n+1}$ to pixel column $P_{n+1+k}$.

In some implementations, the second compensation reference area DR2 overlaps with the second compensation area DC2. In some implementations, the second compensation reference area DR2 is adjacent to but does not overlap with the second compensation area DC2.

In some implementations, the first compensation reference area DR1 is adjacent to but does not overlap with the first compensation area DC1. Similarly, the second compensation reference area DR2 is adjacent to but does not overlap with the second compensation area DC2. As an example, the pixel columns in the first compensation reference area DR1 are pixel column $P_{n-3}$ and pixel column $P_{n-2}$, and the pixel columns in the first compensation area DC1 are pixel column $P_{n-1}$ and pixel column $P_n$. The pixel columns in the second compensation reference area DR2 are pixel column $P_{n+3}$ and pixel column $P_{n+4}$, and the pixel columns in the second compensation area DC2 are pixel column $P_{n+1}$ and pixel column $P_{n+2}$. That is, the first compensation reference area DR1 is adjacent to but does not overlap with the first compensation area DC1, and the first compensation reference area DR1 and the first compensation area DC1 each include two pixel columns. Similarly, the second compensation reference area DR2 is adjacent to but does not overlap with the second compensation area DC2, and the second compensation reference area DR2 and the second compensation area DC2 each include two pixel columns.

In other implementations of the disclosure, the number of the pixel columns included in each of the first compensation reference area DR1, the first compensation area DC1, the second compensation reference area DR2, and the second compensation area DC2 can be set according to actual demands, such as, three, four, or five, which is not limited in the disclosure.

Figure 3:
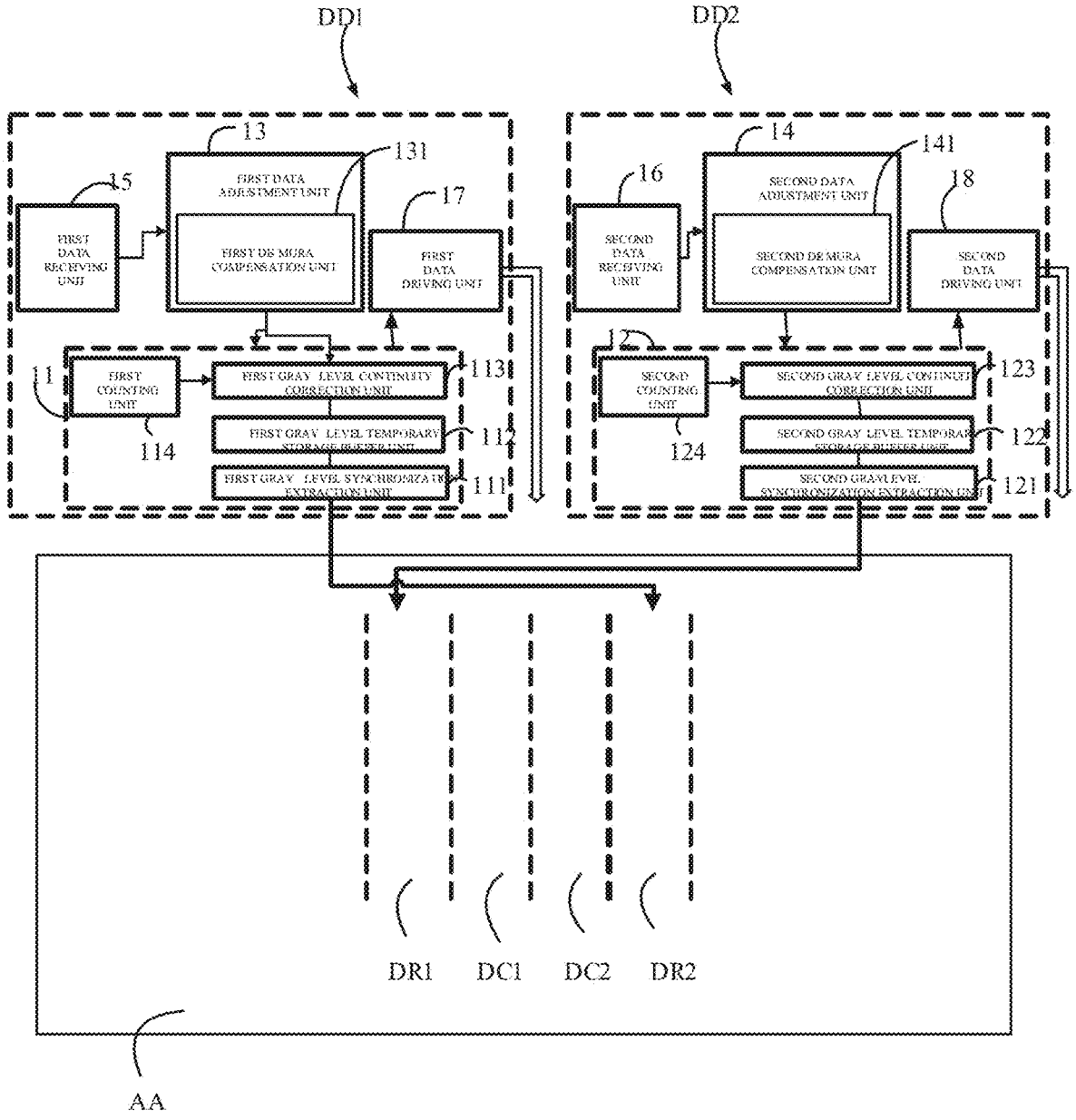
FIG. 3 is a schematic diagram illustrating circuit modules of a first data driving module and a second data driving module according to implementations.

FIG. 3 is a schematic diagram illustrating circuit modules of a first data driving module DD1 and a second data driving module DD2. The first data driving module DD1 includes a first data compensation unit 11, a first data adjustment unit 13, a first data receiving unit 15, and a first data driving unit 17.

The first data receiving unit 15 is configured to receive a current frame of image data to-be-displayed (i.e., a current picture) from outside. In the implementation, the first data receiving unit 15 may be a data connection interface, such as a mobile industry processor interface (MIPI).

The first data adjustment unit 13 is configured to compensate the image data to-be-displayed. The compensation herein mainly includes De-Mura compensation. The first data adjustment unit 13 is further configured to perform data processing on the image data by executing a CE algorithm or a DBC algorithm.

In some implementations, the first data adjustment unit 13 includes a first De-Mura compensation unit 131. The first De-Mura compensation unit 131 is configured to obtain, with a display-panel brightness obtaining unit, overall brightness information of the display area AA of the display panel 10. The overall brightness information includes brightness information for each of pixel units $P_x$ of the first display area A1 and the second display area A2. The display-panel brightness obtaining unit may be a charge coupled device (CCD) camera.

The first De-Mura compensation unit 131 is configured to calculate, based on the obtained overall brightness information, compensation coefficients of 0-255 gray levels for each pixel unit of the first display area A1 and the second display area A2. The compensation coefficient corresponds to the whole display area AA, that is, the first display area A1 and the second display area A2 are treated as a whole.

The first De-Mura compensation unit 131 is further configured to separate brightness information and compensation coefficients corresponding to the first display area A1 from the overall brightness information, that is, to segment the overall brightness information into first brightness (information) corresponding to the first display area A1 and second brightness (information) corresponding to the second display area A2.

As an example, in order to obtain brightness (information) of each pixel unit $P_x$ with a relatively small amount of data, the display-panel brightness obtaining unit is configured to obtain brightness information of each R, G, B pixel unit $P_x$ of one gray level, for other gray levels, the display area is divided into multiple blocks such as areas of 8*8 or areas of 16*16, then brightness information of each block can be obtained with respect to R, G and B pixels.

The first De-Mura compensation unit 131 is configured to fit, according to the separated brightness information corresponding to the first display area A1, the compensation coefficient of each of 0-255 gray levels for each pixel unit $P_x$ through calculations in horizontal and vertical directions. The first De-Mura compensation unit 131 is further configured to compensate image data of the first display area A1 according to the compensation coefficient of each gray level, to complete De-Mura compensation on the image data of the first display area A1.

The first data compensation unit 11 is configured to obtain image data of the second compensation reference area DR2 in the second display area A2, and obtain a first difference of image data of two adjacent pixel columns in the second compensation reference area DR2 along the first direction X, that is, to obtain a first difference of image data of two adjacent pixel columns in a same row of the second compensation reference area DR2 along the first direction X. As illustrated in FIG. 2, the first difference is a difference of image data of pixel column $P_{n+4}$ and pixel column $P_{n+3}$. As an example, image data of a pixel unit $P_x$ in the pixel column $P_{n+3}$ is represented as $D_{n+3}$, and image data of a pixel unit in the pixel column $P_{n+4}$ in a same row as the pixel unit $P_x$ in the pixel column $P_{n+3}$ is represented as $D_{n+4}$, then the first difference is $(D_{n+4})-(D_{n+3})$.

The first difference represents change trend of image data of the second compensation reference area DR2. The first data compensation unit 11 is further configured to perform compensation according to the first difference, to adjust image data of each pixel column in the first compensation area DC1. It can be understood that, the image data of the second compensation reference area DR2 obtain by the first data compensation unit 11 is image data after De-Mura compensation.

The first data driving unit 17 is configured to perform shift operation, caching operation, and digital to analog (D/A) conversion on the image data after De-Mura compensation and compensation for adjustment, and transfer the converted image data to the pixel columns $P_1$-$P_n$ of the first display area A1 for image display.

The second data driving module DD2 includes a second data compensation unit 12, a second data adjustment unit 14, a second data receiving unit 16, and a second data driving unit 18.

The second data receiving unit 16 is configured to receive a current frame of image data to-be-displayed from outside. In the implementation, the second data receiving unit 16 may be a data connection interface, such as an MIPI.

The second data adjustment unit 14 is configured to adjust (i.e., compensate) the image data to-be-displayed. The adjustment herein mainly includes De-Mura compensation. The second data adjustment unit 14 is further configured to perform data processing on the image data by executing a CE algorithm or a DBC algorithm.

In some implementations, the second data adjustment unit 14 includes a second De-Mura compensation unit 141. The second De-Mura compensation unit 141 is the same as the first De-Mura compensation unit 131 in terms of working principle and working mode. That is, overall brightness information of the display area AA of the display panel 10 is obtained by the display-panel brightness obtaining unit.

The second De-Mura compensation unit 141 is configured to calculate, based on the obtained overall brightness information, compensation coefficients of 0-255 gray levels for each pixel unit.

The second De-Mura compensation unit 141 is further configured to separate brightness information corresponding to the second display area A2 from the overall brightness information, that is, to segment the overall brightness information into first brightness (information) corresponding to the first display area A1 and second brightness (information) corresponding to the second display area A2.

The second De-Mura compensation unit 141 is configured to fit, according to the separated brightness information corresponding to the second display area A2, the compensation coefficient of each of 0-255 gray levels for each pixel unit $P_x$ through calculations in horizontal and vertical directions. The second De-Mura compensation unit 141 is further configured to compensate image data of the second display area A2 according to the compensation coefficient of each gray level, to complete De-Mura compensation on the image data of the second display area A2.

The second data compensation unit 12 is configured to obtain image data of the first compensation reference area DR1, and obtain a second difference of image data of two adjacent pixel columns in the first compensation reference area DR1 along the first direction X, that is, to obtain a second difference of image data of two adjacent pixel columns in a same row of the first compensation reference area DR1 along the first direction X. As illustrated in FIG. 2, the second difference is a difference of image data of pixel column $P_{n-3}$ and pixel column $P_{n-2}$. As an example, image data of a pixel unit $P_x$ in the pixel column $P_{n-3}$ is represented as $D_{n-3}$, and image data of a pixel unit in the pixel column $P_{n-2}$ in a same row as the pixel unit $P_x$ in the pixel column $P_{n-3}$ is represented as $D_{n-2}$, then the second difference is $(D_{n-2})-(D_{n-3})$.

The second difference represents change trend of image data of the first compensation reference area DR1. The second data compensation unit 12 is further configured to perform, according to the second difference, compensation on image data of each pixel column in the second compensation area DC2. It can be understood that, the image data of the first compensation reference area DR1 obtain by the second data compensation unit 12 is image data after De-Mura compensation.

The second data driving unit 18 is configured to perform shift operation, caching operation, and D/A conversion on the image data after De-Mura compensation and compensation for adjustment, and transfer the converted image data to the pixel column $P_{n+1}$-$P_m$ of the second display area A2 for image display.

In some implementations, during compensation of the second compensation area DC2, in addition to the change trend of image data of the first compensation reference area DR1, the change trend of image data of the second compensation reference area DR2 adjacent to the second compensation area DC2 is also taken into consideration. That is, the change trend of the image data of the first compensation reference area DR1 and the change trend of the image data of the second compensation reference area DR2 are taken into account, to optimize compensation effect. Similarly, during compensation of the first compensation area DC1, the change trend of the image data of the first compensation reference area DR1 and the change trend of the image data of the second compensation reference area DR2 are taken into account.

For the first data driving module DD1 configured to provide image data for the first display area A1 and the second data driving module DD2 configured to provide image data for the second display area A2, since both brightness information obtained by the (first) De-Mura compensation unit of the first data driving module DD1 and brightness information obtained by the (second) De-Mura compensation unit of the second data driving module DD2 are overall brightness information of the display area AA, the obtained overall brightness information of the display area AA needs to be further segmented according to pixel columns of the first display area A1 and the second display area A2. For a block acrossing the first display area A1 and the second display area A2, brightness data corresponding to brightness information of the block needs to be segmented, so that segmented brightness information of the first display area A1 is obtained, the segmentation, however, will directly result in loss of brightness information of the second display area A2. Similarly, segmented brightness information of the second display area A2 is obtained, the segmentation, however, will directly result in loss of brightness information of the first display area A1. That is, for pixel units $P_x$ at positions adjacent to the first display area A1 and the second display area A2, the obtained brightness information will lose reference brightness information indicating change trend.

In the subsequent horizontal expansion fitting calculation, since left or right reference data is missing in compensation data of each pixel column P in a boundary area A of the first display area A1 and the second display area A2, and also due to accuracy error of an operation system and linear fitting calculation error, gray-level discontinuity of image data of pixel columns in the boundary area (e.g., the first compensation area DC1 and the second compensation area DC2) occurs, resulting in a black line on the screen. Through the research, we found the reason for appearance of a black line when the display panel displays an image.

In the disclosure, compensation for the first compensation area DC1 is performed by the first data compensation unit 11 and compensation for the second compensation area DC2 is performed by the second data compensation unit 12, so that change trend of image data of pixel columns $P_{n-1}$ and $P_n$ as well as pixel columns $P_{n+1}$ and $P_{n+2}$ in the boundary area is smooth, and a difference between image data of the pixel column $P_n$ and image data of the pixel column $P_{n+1}$ is less than a first threshold. As such, image data in the boundary area are in a continuous distribution visually without perceiving a black line. The first threshold may be set according to the actual situation, as long as a black line is not perceived by a user visually. In some implementations, in order to ensure better visual effect, both the number of pixel columns of the first compensation area DC1 and the number of pixel columns of the second compensation area DC2 may be expanded to three from two (i.e., two pixel columns of the first display area A1 and two pixel columns of the second display area A2 in the boundary area).

As illustrated in FIG. 3, the first data compensation unit 11 includes a first gray-level synchronization extraction unit 111, a first gray-level temporary storage buffer unit 112, a first gray-level continuity correction unit 113, and a first counting unit 114.

The first gray-level synchronization extraction unit 111 is configured to obtain reference image data in the second compensation reference area DR2 of the second display area A2.

The first gray-level temporary storage buffer unit 112 is configured to store the obtained reference image data.

The first gray-level continuity correction unit 113 is configured to compensate, according to the reference image data in the second compensation reference area DR2, image data of the first compensation area DC1.

In some implementations, the first gray-level continuity correction unit 113 is configured to obtain the first difference by comparing image data of two adjacent pixel columns in a same row of the second compensation reference area DR2 along the first direction X, and adjust, according to the first difference, image data of each pixel column in the first compensation area DC1.

The first counting unit 114 is configured to identify a predetermined position of each pixel column in the first compensation area DC1, and count image data of each pixel unit $P_x$ in the pixel column P of the first compensation area DC1.

The second data compensation unit 12 includes a second gray-level synchronization extraction unit 121, a second gray-level temporary storage buffer unit 122, a second gray-level continuity correction unit 123, and a second counting unit 124.

The second gray-level synchronization extraction unit 121 is configured to obtain reference image data in the first compensation reference area DR1 of the first display area A1.

The second gray-level temporary storage buffer unit 122 is configured to store the obtained reference image data.

The second gray-level continuity correction unit 123 is configured to compensate, according to the reference image data in the first compensation reference area DR1, image data of the second compensation area DC2.

In some implementations, the second gray-level continuity correction unit 123 is configured to obtain the second difference by comparing image data of two adjacent pixel columns in a same row of the first compensation reference area DR1 along the first direction X, and adjust, according to the second difference, image data of each pixel column in the second compensation area DC2.

The second counting unit 124 is configured to identify a predetermined position of each pixel column in the second compensation area DC2, and count image data of each pixel unit $P_x$ in the pixel column of the second compensation area DC2.

The first gray-level synchronization extraction unit 111, the first gray-level temporary storage buffer unit 112, the first gray-level continuity correction unit 113, and the first counting unit 114 of the first data compensation unit 11 as well as the second gray-level synchronization extraction unit 121, the second gray-level temporary storage buffer unit 122, the second gray-level continuity correction unit 123, and the second counting unit 124 of the second data compensation unit 12 may be circuit hardwares or software programs.

Figure 4:
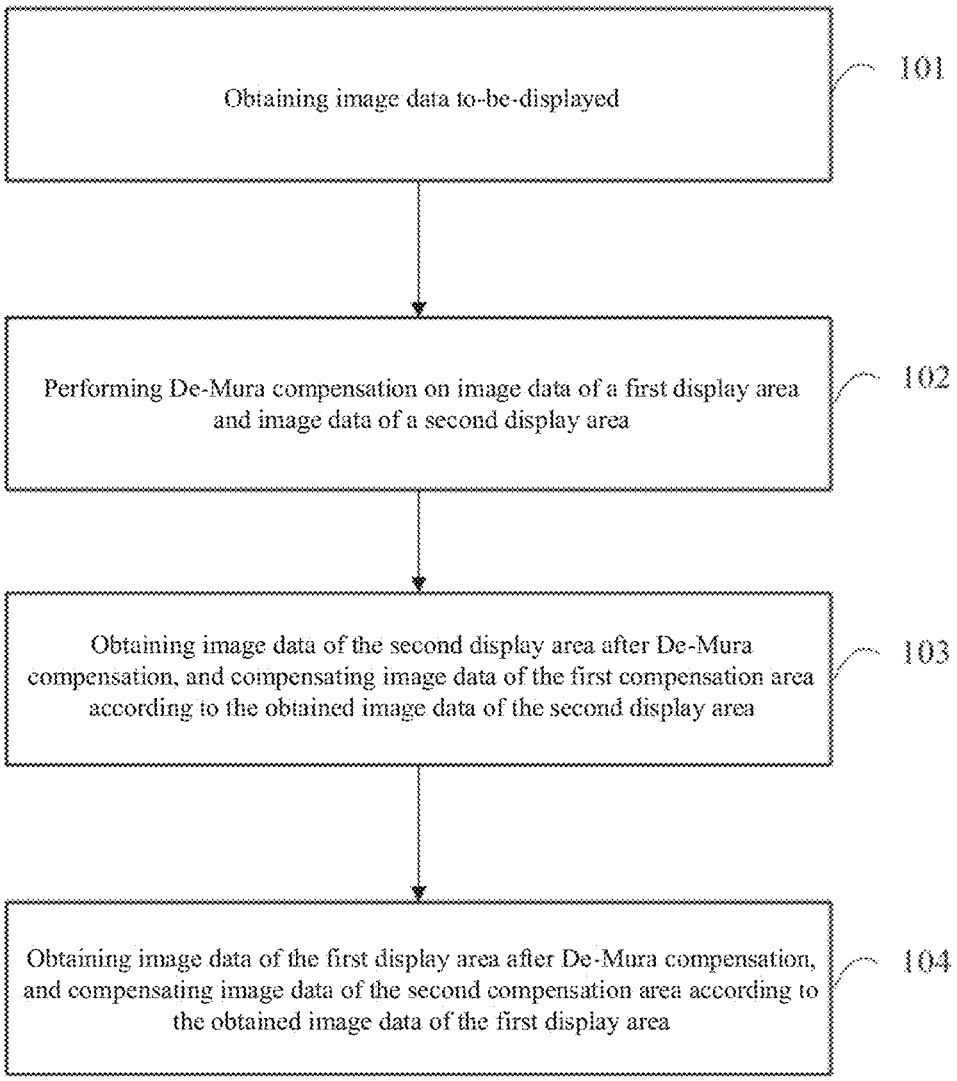
FIG. 4 is a schematic flowchart illustrating an image data compensation method of the display panel illustrated in FIG. 1 and FIG. 2 according to implementations.
Figure 5:
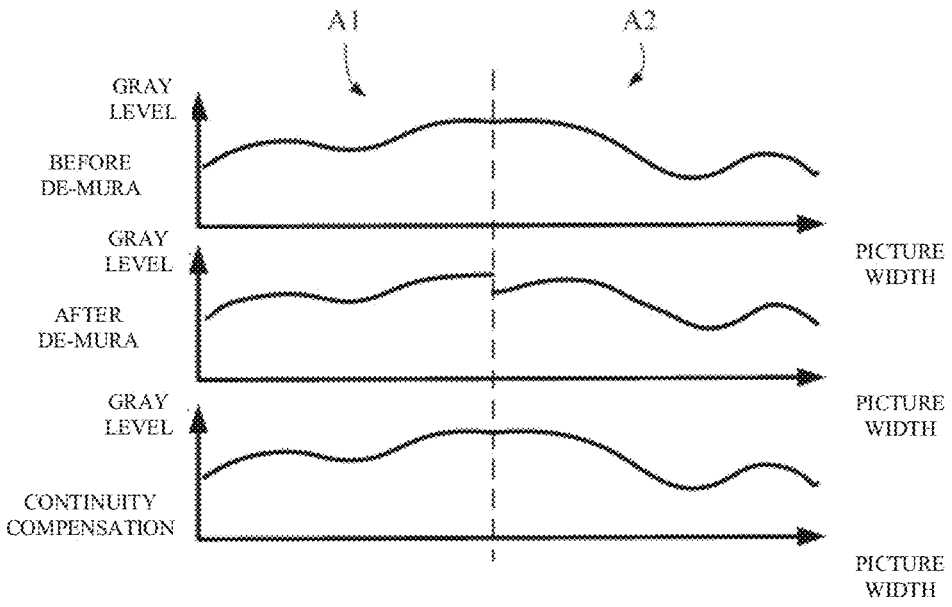
FIG. 5 is a schematic diagram illustrating image data compensation of the display panel illustrated in FIG. 1 and FIG. 2 according to implementations.

FIG. 4 is a schematic flowchart illustrating an image data compensation method of the display panel 10 illustrated in FIG. 1 and FIG. 2 according to implementations. FIG. 5 is a schematic diagram illustrating image data compensation of the display panel 10 illustrated in FIG. 1 and FIG. 2 according to implementations. As illustrated in FIG. 4 and FIG. 5, the method includes the following.

At block 101, image data to-be-displayed is obtained. That is, the image data to-be-displayed is received by the first data receiving unit 15 from outside. In this case, as illustrated in FIG. 5, received image data for the first display area A1 and received image data for the second display area A2 are in a continuous distribution, that is, the display of the first display area A1 and the second display area A2 is continuous before De-Mura compensation.

At block 102, De-Mura compensation is performed on image data of a first display area A1 and image data of a second display area A2.

As an example, for the first display area A1, overall brightness information of the display area AA in the display panel 10 is obtained by the display-panel brightness obtaining unit. According to the obtained brightness information, compensation coefficient of each of 0-255 gray levels for each pixel unit $P_x$ is fitted through calculations in horizontal and vertical directions. The image data of the first display area A1 is compensated by the first De-Mura compensation unit 131 with the compensation coefficient of each gray level, to perform De-Mura compensation on the image data.

Similarly, for the second display area A2, overall brightness information of the display area AA in the display panel 10 is obtained by the second De-Mura compensation unit 141 by means of the display-panel brightness obtaining unit. According to the obtained brightness information, compensation coefficient of each of 0-255 gray levels for each pixel unit $P_x$ is fitted through calculations in horizontal and vertical directions. With the compensation coefficient, De-Mura compensation is performed on the image data of each pixel unit $P_x$ of the second display area A2.

As illustrated in FIG. 5, since De-Mura compensation for the first display area A1 and De-Mura compensation for the second display area A2 are performed by the first data driving module DD1 and the second data driving module DD2 separately, the display of the first display area A1 and the second display area A2 after De-Mura compensation is not continuous in the boundary area, resulting in a black line.

At block 103, image data of the second display area A2 after De-Mura compensation is obtained, and image data of the first compensation area DC1 is compensated according to the obtained image data of the second display area A2.

In some implementations, image data of the second compensation reference area DR2 of the second display area A2 is obtained. A first difference of image data of two adjacent pixel columns in a same row of the second compensation reference area DR2 along the first direction X is calculated, where the first difference represents change trend of the image data of the second compensation reference area DR2. Image data of each pixel column in the first compensation area DC1 is compensated according to the first difference.

As an example, a predetermined position of each pixel column in the first compensation area DC1 is identified by the counting unit 114, and image data of each pixel unit $P_x$ in the pixel column(s) of the first compensation area DC1 is counted.

Reference image data in the second compensation reference area DR2 of the second display area A2 is obtained by the first gray-level synchronization extraction unit 111, and the reference image data is stored by the first gray-level temporary storage buffer unit 112.

The first difference is obtained by the first gray-level continuity correction unit 113 by comparing image data of two adjacent pixel columns in a same row of the second compensation reference area DR2 along the first direction X. Image data of each pixel column in the first compensation area DC1 is adjusted according to the first difference.

At block 104, image data of the first display area A1 after De-Mura compensation is obtained, and image data of the second compensation area DC2 is compensated according to the obtained image data of the first display area A1.

In some implementations, image data of the first compensation reference area DR1 of the first display area A1 is obtained. A second difference of image data of two adjacent pixel columns in a same row of the first compensation reference area DR1 along the first direction X is obtained, where the second difference represents change trend of the image data of the first compensation reference area DR1. Image data of each pixel column in the second compensation area DC2 is compensated according to the second difference.

It can be understood that, the image data of the second compensation reference area DR2 obtained by the first data compensation unit 11 is image data after De-Mura compensation. Based on the above, change trend of the image data of the first compensation area DC1 and the image data of the second compensation area DC2 is smooth and continuous.

As an example, a predetermined position of each pixel column in the second compensation area DC2 is identified by the counting unit 124, and image data of each pixel unit $P_x$ in the pixel column(s) of the second compensation area DC2 is counted.

Reference image data in the first compensation reference area DR1 of the first display area A1 is obtained by the second gray-level synchronization extraction unit 121, and the reference image data is stored by the second gray-level temporary storage buffer unit 122.

According to the reference image data in the first compensation reference area DR1, image data of the second compensation area DC2 is compensated by the second gray-level continuity correction unit 123. Specifically, the second difference is obtained by the second gray-level continuity correction unit 123 by comparing image data of two adjacent pixel columns in a same row of the first compensation reference area DR1 along the first direction X. Image data of each pixel column in the second compensation area DC2 is adjusted according to the second difference.

As illustrated in FIG. 5, after performing compensation of continuity for the first display area A1 and the second display area A2, received image data for the first display area A1 and received image data for the second display area A2 are in a continuous distribution. That is, in the disclosure, the display of the first display area A1 and the second display area A2 after De-Mura compensation can still remain continuous, which can effectively avoid appearing of a black line after De-Mura compensation, thereby ensuring quality of image display.

It should be noted that, the execution order of the operations at block 103 and the operations at block 104 is not limited in the disclosure. The operations at block 103 and the operations at block 104 may be executed synchronously or in sequence.

While the principles and implementations of the disclosure have been described in connection with illustrative implementations, it is to be understood that foregoing implementations are merely used to help understand the core idea of the disclosure. As will occur to those skilled in the art, the disclosure is susceptible to various modifications and changes without departing from the spirit and principle of the disclosure. Therefore, the disclosure is not to be limited to the disclosed implementations.

What is claimed is:

1. A display panel, having a first display area and a second display area adjacent to each other along a first direction, the first display area comprising a plurality of pixel columns $P_1$-$P_n$ sequentially arranged along the first direction, and the second display area comprising a plurality of pixel columns $P_{n+1}$-$P_m$ sequentially arranged along the first direction, wherein the first display area comprises a first compensation area, the first compensation area at least comprises the pixel column $P_n$; the second display area comprises a second compensation area, the second compensation area is adjacent to the first display area and at least comprises the pixel column $P_{n+1}$, wherein m is a positive integer greater than n;

the display panel comprises a first data driving module and a second data driving module, wherein the first data driving module is configured to provide an image data signal for the pixel columns $P_1$-$P_m$ and the second data driving module is configured to provide an image data signal for the pixel columns $P_{n+1}$-$P_m$, wherein the first data driving module is configured to perform De-Mura compensation on the first display area, obtain image data of the second display area after De-Mura compensation, and adjust image data of the first compensation area according to the obtained image data of the second display area; and the second data driving module is configured to perform De-Mura compensation on the second display area, obtain image data of the first display area after De-Mura compensation, and adjust image data of the second compensation area according to the obtained image data of the first display area, wherein the adjusted image data of the first compensation area and the adjusted image data of the second compensation area are in a continuous distribution.

2. The display panel of claim 1, wherein the first display area further comprises a first compensation reference area, the first compensation reference area is adjacent to the second display area and at least comprises two pixel columns; the second display area further comprises a second compensation reference area, the second compensation reference area is adjacent to the first display area and at least comprises two pixel columns;

the first data driving module is configured to obtain image data of the second compensation reference area after De-Mura compensation, and adjust the image data of the first compensation area according to the obtained image data of the second compensation reference area; and the second data driving module is configured to obtain image data of the first compensation reference area after De-Mura compensation, and adjust the image data of the second compensation area according to the obtained image data of the first compensation reference area.

3. The display panel of claim 2, wherein the first data driving module comprises a first data compensation unit and a first data adjustment unit, and the second data driving module comprises a second data compensation unit and a second data adjustment unit;

the first data adjustment unit is configured to perform De-Mura compensation on the first display area to adjust image data of the first display area; the first data compensation unit is configured to obtain the image data of the second compensation reference area after De-Mura compensation, and compensate the image data of the first compensation area according to the obtained image data of the second compensation reference area; and the second data adjustment unit is configured to perform De-Mura compensation on the second display area to adjust image data of the second display area; the second data compensation unit is configured to obtain the image data of the first compensation reference area after De-Mura compensation, and compensate the image data of the second compensation area according to the obtained image data of the first compensation reference area.

4. The display panel of claim 3, wherein the first data compensation unit configured to compensate the image data of the first compensation area according to the obtained image data of the second compensation reference area, comprises:

obtaining a first difference of image data of two adjacent pixel columns in the second compensation reference area along the first direction, and compensating image data of each pixel column in the first compensation area according to the first difference; and the second data compensation unit configured to compensate the image data of the second compensation area according to the obtained image data of the first compensation reference area, comprises:

obtaining a second difference of image data of two adjacent pixel columns in the first compensation reference area along the first direction, and compensating image data of each pixel column in the second compensation area according to the second difference, wherein a difference between the compensated image data of the first compensation area and the compensated image data of the second compensation area is less than a first threshold.

5. The display panel of claim 4, wherein pixel columns in the first compensation reference area comprise: pixel column $P_{n-1}$ to pixel column $P_{n-i+j}$, wherein i is a positive integer greater than 0, and j is a positive integer greater than or equal to i;

pixel columns in the first compensation area comprise: pixel column $P_{n-k}$ to pixel column $P_n$, wherein k is a positive integer greater than or equal to 0;

pixel columns in the second compensation reference area comprise: pixel column $P_{n+1+i}$ to pixel column $P_{n+1+i+j}$; and pixel columns in the second compensation area comprise: pixel column $P_{n+1}$ to pixel column $P_{n+1+k}$, wherein n is a natural number greater than i, j, and k.

6. The display panel of claim 5, wherein the first compensation reference area is adjacent to and does not overlap with the first compensation area, and the second compensation reference area is adjacent to and does not overlap with the second compensation area.

7. The display panel of claim 6, wherein the pixel columns in the first compensation reference area are pixel column $P_{n-3}$ and pixel column $P_{n-2}$, and the pixel columns in the first compensation area are pixel column $P_{n-1}$ and pixel column $P_n$; and the pixel columns in the second compensation reference area are pixel column $P_{n+3}$ and pixel column $P_{n+4}$, and the pixel columns in the second compensation area are pixel column $P_{n+1}$ and pixel column $P_{n+2}$.

8. The display panel of claim 4, wherein the first data compensation unit comprises:

a first gray-level synchronization extraction unit, configured to obtain reference image data in the second compensation reference area of the second display area;

a first gray-level temporary storage buffer unit, configured to store the reference image data;

a first gray-level continuity correction unit, configured to obtain the first difference by comparing the image data of two adjacent pixel columns in the second compensation reference area along the first direction, and adjust the image data of each pixel column in the first compensation area according to the first difference; and a first counting unit, configured to identify a position and range of each pixel column in the first compensation area.

9. The display panel of claim 4, wherein the second data compensation unit comprises:

a second gray-level synchronization extraction unit, configured to obtain reference image data in the first compensation reference area of the first display area;

a second gray-level temporary storage buffer unit, configured to store the reference image data;

a second gray-level continuity correction unit, configured to obtain the second difference by comparing the image data of two adjacent pixel columns in the first compensation reference area along the first direction, and adjust the image data of each pixel column in the second compensation area according to the second difference; and a second counting unit, configured to identify a position and range of each pixel column in the second compensation area.

10. An image data compensation method of a display panel, the display panel having a first display area and a second display area adjacent to each other along a first direction, the first display area comprising a plurality of pixel columns $P_1$-$P_n$ sequentially arranged along the first direction, the second display area comprising a plurality of pixel columns $P_{n+1}$-$P_m$ sequentially arranged along the first direction, the first display area comprising a first compensation area which at least comprises the pixel column $P_n$, and the second display area comprising a second compensation area which is adjacent to the first display area and at least comprises the pixel column $P_{n+1}$, the image data compensation method comprising:

obtaining image data to-be-displayed;

performing De-Mura compensation on image data of the first display area and image data of the second display area;

obtaining image data of the second display area after De-Mura compensation, and compensating image data of the first compensation area according to the obtained image data of the second display area; and obtaining image data of the first display area after De-Mura compensation, and compensating image data of the second compensation area according to the obtained image data of the first display area, wherein the compensated image data of the first compensation area and the compensated image data of the second compensation area are in a continuous distribution.

11. The image data compensation method of claim 10, wherein the first display area further comprises a first compensation reference area, the first compensation reference area is adjacent to the second display area and at least comprises two pixel columns; the second display area further comprises a second compensation reference area, the second compensation reference area is adjacent to the first display area and at least comprises two pixel columns;

obtaining the image data of the second display area after De-Mura compensation, and compensating the image data of the first compensation area according to the obtained image data of the second display area comprise:

obtaining image data of the second compensation reference area after De-Mura compensation, and adjusting the image data of the first compensation area according to the obtained image data of the second compensation reference area; and obtaining the image data of the first display area after De-Mura compensation, and compensating the image data of the second compensation area according to the obtained image data of the first display area comprise:

obtaining image data of the first compensation reference area after De-Mura compensation, and adjusting the image data of the second compensation area according to the obtained image data of the first compensation reference area.

12. The image data compensation method of claim 11, wherein adjusting the image data of the first compensation area according to the obtained image data of the second compensation reference area comprises:

obtaining a first difference of image data of two adjacent pixel columns in the second compensation reference area along the first direction, and compensating image data of each pixel column in the first compensation area according to the first difference; and adjusting the image data of the second compensation area according to the obtained image data of the first compensation reference area comprises:

obtaining a second difference of image data of two adjacent pixel columns in the first compensation reference area along the first direction, and compensating image data of each pixel column in the second compensation area according to the second difference.

13. The image data compensation method of claim 11, wherein pixel columns in the first compensation reference area comprise: pixel column $P_{n-i}$ to pixel column $P_{n-i+j}$, wherein i is a positive integer greater than 0, and j is a positive integer greater than or equal to i;

pixel columns in the first compensation area comprise: pixel column $P_{n-k}$ to pixel column $P_n$, wherein k is a positive integer greater than or equal to 0;

pixel columns in the second compensation reference area comprise: pixel column $P_{n+1+i}$ to pixel column $P_{n+1+i+j}$; and pixel columns in the second compensation area comprise: pixel column $P_{n+1}$ to pixel column $P_{n+1+k}$, wherein n is a natural number greater than i, j, and k.

14. The image data compensation method of claim 13, wherein the first compensation reference area is adjacent to and does not overlap with the first compensation area, and the second compensation reference area is adjacent to and does not overlap with the second compensation area.

15. The image data compensation method of claim 14, wherein the pixel columns in the first compensation reference area are pixel column $P_{n-3}$ and pixel column $P_{n-2}$, and the pixel columns in the first compensation area are pixel column $P_{n-1}$ and pixel column $P_n$; and the pixel columns in the second compensation reference area are pixel column $P_{n+3}$ and pixel column $P_{n+4}$, and the pixel columns in the second compensation area are pixel column $P_{n+1}$ and pixel column $P_{n+2}$.

* * * * *